United States Patent [19]

Koella, III

[11] 3,996,731

[45] Dec. 14, 1976

[54] APPARATUS FOR CONVEYING AND BREAK SPINNING FIBERS

[75] Inventor: Ernest Koella, III, Rockford, Tenn.

[73] Assignee: Rockford Manufacturing Company, Rockford, Tenn.

[22] Filed: Feb. 6, 1975

[21] Appl. No.: 547,619

[52] U.S. Cl. ..... 57/58.95; 19/105; 19/106 R; 57/50

[51] Int. Cl.[2] ..... D01H 1/12

[58] Field of Search ..... 57/50, 58.89–58.95; 19/105–106

[56] References Cited

UNITED STATES PATENTS

| | | | |
|---|---|---|---|
| 3,355,869 | 12/1967 | Vorisek | 57/58.95 |
| 3,391,430 | 7/1968 | Bryan, Jr. | 19/106 R X |
| 3,601,969 | 8/1971 | Susami et al. | 57/58.95 X |
| 3,709,406 | 1/1973 | Binder et al. | 19/105 X |

*Primary Examiner*—Richard C. Queisser
*Assistant Examiner*—Charles Gorenstein
*Attorney, Agent, or Firm*—Burns, Doane, Swecker & Mathis

[57] ABSTRACT

The invention is employed to convey and break spin fibers and involves a single cylindrical opening means which separates a fibrous bat into individual fibers. A suitable feeding means is operably associated with the opening means and serves to feed the fiber bat to the opening means. A plurality of conduits open adjacent to the peripheral surface of the cylindrical opening means and each conduit extends to a discrete location remote from the opening means. Fibers are drawn from the peripheral surface of the opening means into and along the length of the conduits by a suction introduced through a vacuum manifold opening into the conduit. Connected to each of the conduits remote from the opening means is a break spinner which spins into yarn fibers conducted from the opening means.

8 Claims, 1 Drawing Figure

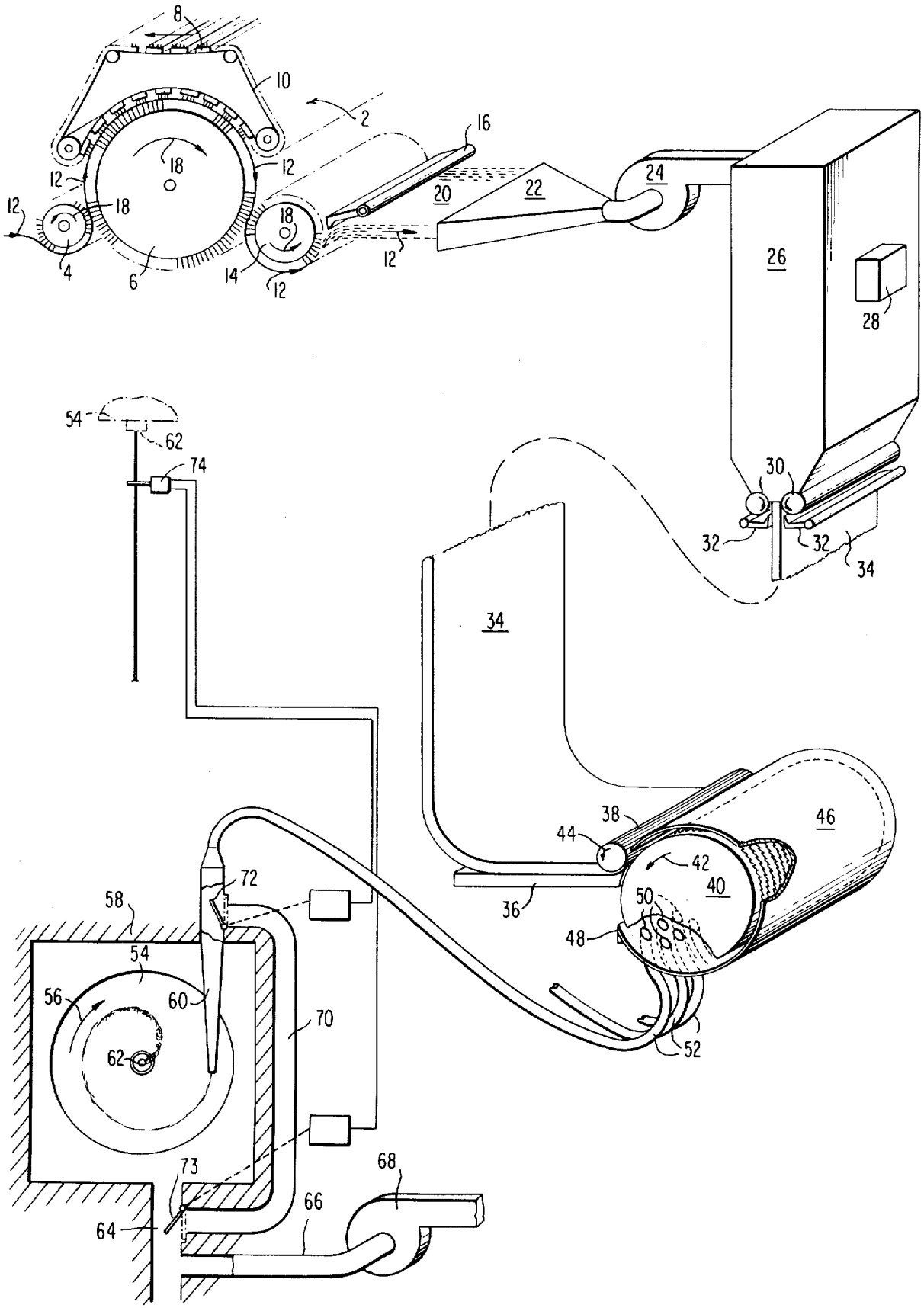
8
10
2
16
18
12
20
22
24
26
28
4
6
14
30
32
34
36
38
40
42
44
46
48
50
52
54
56
58
60
62
64
66
68
70
72
73
74

APPARATUS FOR CONVEYING AND BREAK SPINNING FIBERS

BACKGROUND OF THE INVENTION

The present invention relates generally to an apparatus for conveying and break spinning fibers. More particularly, the invention relates to an apparatus for carding and conveying fibers in the form of a relatively uniform bat to a single opening roller from which fibers can be drawn to a plurality of break spinners, each equipped with a bypass operable in the event that an end comes down on the individual spinners.

In break spinning, winding and twisting are conducted at quite distinct phases of total spinning operation. Breaks, i.e., discontinuities, are deliberately introduced to the flow of fibers. Indeed, the process may be visualized as the transfer from the supply of fibers to a yarn being twisted of individual fibers at discrete intervals of time. The creation of the breaks or discontinuities results in the existence of what is often termed an "open end" to the yarn being twisted.

As the fibers travel individually across the break, each becomes essentially sequentially attached to the open end of the yarn. Concurrently, the yarn is twisted to an essentially finished aggregate of fibers.

Theoretically, because the twisting operation is isolated from the source of fibers, twist can be developed in the yarn simply by rotating the open end. Because small objects are usually of a lesser inertia, the small open end of the yarn can be twisted at high speeds and the spinning operation conducted more efficiently.

A relatively small amount of power is needed to twist or rotate the yarn. Because the spinning is discrete from the winding operation, the yarn can be wound into larger packages and the entire operation rendered more economical.

As suggested, break spinning makes it possible to conduct spinning operations at higher speeds and in a more productive manner. The cost of doffing and winding packages of yarn can be decreased in relation to the increased size of the packages and theoretically less power per unit of production is consumed. Labor costs also become less important in relation to the cost of power and the capital required.

Although the advent of break spinning represents a significant advance over other techniques, a number of problems are presented. Much of the equipment for break spinning may involve ineffective techniques for automatically transporting the fiber through the various stages of the overall spinning operation. Some techniques may employ mechanical approaches to the transport of the fiber in which the fiber is mechanically operated upon to move it from one place to another. Other techniques involve the use of electrostatic forces to draw fiber between certain stages of the spinning operation. Neither technique appears to be fully effective in transporting the fibers. The mechanical techniques often incompletely move the fiber and thus a certain quantity of fiber may be left behind. The electrostatic technique may not provide forces of magnitude sufficient to effect complete movement of fiber from one phase of the operation to another.

In the break spinning techniques employed heretofore, a pin beater or opening roller is employed to separate a fiber mass into individual fibers. These individual fibers are thereafter conveyed to a single break spinner by complex operating members. In other words, there is an individual break spinner for each opening roller. Associated with each break spinner are various elements such as feed rollers and pedals which maintain the incoming fiber mass in proper contact with the opening roller. In other words, each break spinner requires an individual apparatus for the separation of the fibrous mass into individual fibers. Inasmuch as each spinning machine thus entails the compounding of numerous break spinners and associated apparatus for opening the fibrous mass into individual fibers, a great number of moving parts are involved. The number and complexity of the various structures entails rather greater capital expense, as well as expense in the maintenance and operation of the spinning machine.

Many of the break spinning devices of the prior art do not maintain effective control over the density of the fiber mass once the fibers are drawn from the card but prior to the spinning of the fibers into yarns. Because ineffective control is exerted over the density of the fiber mass, the operation of separating the fiber mass into individual fibers may be rendered less effective, with the result that individual yarns may vary in thickness or density. This is of course undesirable where yarns of uniform quality are required.

The density or thickness of a yarn many also vary as a result of ineffective withdrawal of individual fibers from the opening roll to feed a break spinner. This appears to be a problem with numerous of the devices of the prior art wherein aggregates of fibrers rather than individual fibers may be withdrawn from the opening roll. Alternatively, the apparatus may fail to remove any fibers at all from the opening roll during an excessive period of time. Optimally, individual fibers should be removed from the opening roll at a rate selected to provide a yarn of a particular density and/or thickness. Devices of the prior art may not be sufficiently reliable in this respect.

The uniformity of a yarn may also be affected by the degree to which the individual fibers are curled, twisted, or looped as they, individually, join the open end of the yarn. For optimal uniformity in the density and thickness of the yarn, the fibers should remain relatively straight and parallel to one another with only one end thereof initially joining the open end of the yarn.

Many devices of the prior art fail to ensure this smooth mode of movement of each fiber into the spinner and onto the open end of the yarn. These devices often permit the fibers to become curled and improperly oriented and thus cause the resulting yarns to be irregular in density and thickness.

From time to time, it may be desired to alter the quality of yarn produced by an individual spinning machine. This can be accomplished in a number of ways. One way involves a change in the flux, i.e., the flow of individual fibers to the open end of the yarn. In any case, the spinning machine must be susceptible to convenient and rapid conversion so that the cost of the change may be minimized. Additionally, the machine must be capable of effecting the change in an accurate manner so that yarn is not wasted in the initial phases of the subsequent operation. Many break spinning devices of the prior art are not susceptible to a rapid, efficient and accurate change preparatory to producing a yarn of a different quality. As a result, these devices are less versatile and effecient than may be desired.

In any break spinning apparatus, the fibers transported to the spinner must be condensed from a rather low level of flux to a substantially higher level of flux. In condensing the fibers, they become grouped together at the open end of the yarn and connected thereto as the yarn is twisted. In order to maintain a yarn of uniform density and thickness, the fibers must be smoothly condensed. Many break spinning devices of the prior art do not afford sufficiently smooth condensation, but rather bring the fibers together in a rather tangled, nonparallel manner. This results in the formation of a yarn of undesirably variable density and thickness.

The opening rollers separating a fiber mass into individual fibers preparatory to spinning these individual fibers into a yarn be thoroughly cleaned of fiber as additional fibers are introduced to the opening roller. Many of the break spinning devices of the prior art do not afford efficient and thorough removal of fibers from the opening roll. Thus the fiber many become matted to the roller or wrapped therearound at various locations along the length of the roller.

From time to time as spinning operations progress, the continuous mass of fibers may break so that an end, rather than a continuous mass, is fed toward the twister. If a mass of fibers is broken, then the spinning operation must, at least in part, be interrupted so that a new continuous mass can be fed. Certain break spinning devices of the prior art require that essentially the entire spinning machine, or at least a significant portion of the productive capacity thereof, be shut down during the rethreading of the spinner. Alternatively, though the yarn is no longer being drawn from the break spinner, fibers continue to be introduced thereto. As a result, fibers may build up in the spinner and the spinner must be cleaned before the apparatus can be rethreaded. In either case, a portion, if not the entire spinning machine, may be out of production while the spinner is rethreaded. The extent of a shutdown or the duration thereof and/or a combination of both, can combine to significantly reduce the productive capacity of a spinning machine.

The problems suggested in the preceding, while not exhaustive, are among many which tend to reduce the effectiveness and desirability of apparatus of the prior art for conveying the break spinning fibers into yarns. Other noteworthy problems may also exist; however, those presented in the discussion above should be sufficient to demonstrate that such apparatus apperaing in the prior art have not been entirely satisfactory.

OBJECTS AND SUMMARY OF THE INVENTION

In light of the foregoing, it is a general object of the invention to improve the conveying and break spinning of fibers into yarns intended to obviate or minimize problems of the type encountered heretofore.

It is a particular object of the invention to provide for conveying and break spinning fibers into yarns wherein the fiber is completely and efficiently transported in an automated manner through the various stages of the spinning operation.

It is another object of the invention to provide for conveying and break spinning fibers wherein a single opening roller for separating the fiber mass into individual fibers is employed to provide fibers to a plurality of break spinners and preferably a multiplicity of such spinners.

It is still another object of the invention to provide for conveying and break spinning fibers wherein the flow of the fiber mass to the opening roller can be relatively carefully controlled so that the density and thickness of the resulting yarn can be maintained within acceptable tolerances.

It is yet still another object of the invention to provide for conveying and break spinning fibers wherein fibers can be removed from the opening roller on an essentially individual basis or in suitably small mass so that the yarn resulting from the spinning of the fibers is of a relatively uniform density and thickness.

It is a further object of the invention to provide for conveying and break spinning fibers wherein the individual fibers can be moved from the opening roller to the break spinner in such a way that the fibers remain straight and essentially parallel to one another in order to provide a yarn of relatively uniform density and thickness.

It is still a further object of the invention to provide for conveying a break spinning fibers wherein the movement of the fibers from the opening roller to the break spinner can be varied quickly, efficiently, and accurately, so as to provide economically yarns of varying density and thickness.

It is yet still a further object of the invention to provide for conveying and break spinning fibers wherein the fibers are smoothly condensed upon entering the break spinner and thus do not become tangled or otherwise disarranged in a manner rendering the resulting yarn of uneven density or thickness.

It is still another object of the invention to provide for conveying and break spinning fibers wherein the fibers are thoroughly and efficiently removed from the opening roller as additional fibers are introduced thereto so that the opening roller does not become matted or the fibers wrapped therearound.

It is yet still another object of the invention to provide for conveying and break spinning fibers wherein spinning operations can be continued in large part despite a break in the length of fibers and in which fibers otherwise conducted into a break spinner can be diverted therearound while the spinner can be rethreaded.

These objects can be accomplished by the use of a single cylindrical opening roller which separates a fibrous bat into individual fibers. Equipment associated therewith feeds the fibrous bat to the opening roller. Individual fibers separated from the bat are conducted away from the opening roller by a plurality of conduits which open adjacent the peripheral surface of the roller. The individual fibers are transported by suction resulting from a vacuum introduced by a vacuum manifold opening into the conduits. The vacuum draws fibers from the peripheral surface of the opening roller and conveys the fibers into and along the length of the conduits.

Each conduit extends to a discrete location remote from the opening roller and conveys the fibers to an individual break spinner remote from the opening roller. The individual break spinners spin the fibers into yarns.

THE DRAWING

The drawing schematically illustrates the apparatus and the mode of transporting and break spinning fibers into a yarn.

DETAILED DESCRIPTION

In broad terms, the apparatus of the invention includes opening means for separating a fiber bat essentially into individual fibers. Feeding means is operably associated with the opening means for the purpose of feeding the fiber bat thereto. Once the fiber bat is separated into individual fibers by the opening means, the essentially individual fibers are conducted to a plurality of break spinning means for the purpose of spinning the fibers into yarns.

As can perhaps best be appreciated from an examination of the FIGURE, the feeding means is comprised of a card, indicated generally at 2. The card 2 includes a licker-in 4 which is intended to advance the fibers to be spun onto a carding cylinder 6. The carding cylinder 6 acts in cooperation with flats 8 located on an endless belt 10 to card the fiber material. The fiber material can be introduced to the card in any suitable form and for instance may take the form of a lap or narrow blanket. In any case, the course of the fibers is indicated generally by the arrows 12.

The fiber material is removed from the carding cylinder 6 by a cylindrical doffer 14. The fiber material is, in turn, removed from the doffer 14 by a doffer comb 16. The licker-in, carding cylinder, doffer, and doffer comb are all somewhat elongated, the licker-in, carding cylinder, and doffer all rotating about longitudinal axes in the directions indicated by the arrows 18.

Preferably, the licker-in, carding cylinder, and doffer, as well as the flats disposed on the endless belt 10, are covered by wires which serve to comb or brush and clean the fiber material. The licker-in 4, flats 8, endless belt 10, doffer 14, and doffer comb 16 may be collectively referred to as carding means. The doffer and doffer comb may be collectively referred to as a card doffing means.

Once the fiber material introduced to the card has been carded, it can be removed from the area of the card by additional feeding means. More particularly, the carded fibers 20 can be removed from the area of the doffer and doffer comb by a high velocity vacuum plenum 22 powered by a fan 24. The pneumatic effect of the plenum and fan transport the carded fibers 20 from the area of the card to a chute 26.

Disposed on the chute 26 is a suitable vibrating means 28, such as a vibrator, which operates to vibrate the chute 26 and thus ensure the settling of the carded fibers uniformly into the lower portions of the chute. Disposed at the lower portion of the chute 26 is a suitable discharging means preferably including discharging rollers 30 and roller combs 32.

Because the discharging rollers and combs operate at a uniform rate, and because the vibrator 38 causes the carded fibers 20 to settle uniformly into the chute 26, the fiber bat 34 of an essentially uniform texture and density can be discharged from the chute 26 and thereafter advanced to the opening means. It will be appreciated that essentially full control is exerted over the density of the material advanced to the opening means so that the yarn ultimately spun is of a uniform, or essentially uniform, density or thickness.

The fiber bat 34 is advanced by appropriate means from the chute 26 to the opening means of the spinning apparatus. The opening means includes a feeding plate 36, one end of which is disposed adjacent and below a feeding roll 38. The feeding roll is in turn disposed tangentially adjacent an elongated cylindrical opening roller 40. The fiber bat 34 passes between the feeding plate 36 and the feeding roll 38 and into contact with the opening roller 40. The opening roller 40 is comprised of a pin or serrated wire beater which serves to separate essentially individual fibers from the fiber bat 34.

The surface of the opening roller rotates at approximately 4 thousand feet per minute in the direction indicated by the arrow 42, while the feeding roller 38 rotates in the direction of the arrow 44. The feeding roller 38 and the opening roller 40 rotate about the longitudinal axes thereof and the magnitude of the longitudinal dimensions of each is essentially equal to the magnitude of the width of the fiber bat 34.

The opening roll 40 is at least partially enclosed by a housing 46 which includes a mote knife 48. The interaction of the feeding plate, feeding roller, opening roller, housing, and mote knife effect the separation of individual fibers from the fiber mass comprising the fiber bat 34. These elements can be referred to collectively as an opening means. The mote knife, of course, will offer an additional cleaning point to remove nonfibrous impurities from the stock being processed.

A plurality of vacuum orifices 50 disposed adjacent the mote knife 48 are employed to doff or remove individual fibers from the opening roller. These vacuum orifices 50 are connected with a plurality of conduits 52 which are thus in open communication with the interior of the housing 46 of the opening means.

In order to cover the full lateral extent of the opening roller, the vacuum orifices 50 may be disposed in a number of rows in staggered relation, as illustrated in the FIGURE, substantially throughout the length of the roller 40. In this case, the sum of the dimensions of the orifices measured parallel to the longitudinal axis of the opening roller is greater than the length of the opening roller.

Alternatively, the conduits can be disposed in a suitable carriage so that the orifices can traverse the opening roller to an extent sufficient to collectively remove fibers from the opening roller along essentially the entire length thereof. The use of individual vacuum orifices disposed closely adjacent the opening roller assists in assuring that only essentially individual fibers, as opposed to unsuitable aggregates thereof, are drawn from the opening roller as the fiber bat is separated into individual fibers. The overlapping or traversing character of the orifices ensures that fibers are cleanly and efficiently removed from the opeing roller as additional fibers are introduced thereto. The matting of fibers on the opening roller, or the wrapping of fibers therearound, at various points in the length of the opening roller is in this way minimized.

Each of the conduits 52 feeds individual fibers in one-to-one relationship to an individual break spinner. Thus, it can be appreciated at this point that a single opening means can be employed to serve a plurality of break spinners and the feeding plate, feeding roller, opening roller, housing, mote knife, and pedal need not be duplicated for each spinner. Moreover, complex feeding apparatus is eliminated.

It can be noted from the illustration that the conduits 52 are relatively slender. The velocity of the air passing therethrough is thus capable of being maintained at a relatively high level so that the individual fibers can be conveyed effectively from the opening roller to the break spinner without becoming unduly curled or improperly oriented. As a result, a yarn of relatively uniform density and thickness can be formed.

The break spinning means of this invention includes a rotor 54 which rotates in the direction indicated by the arrow 56. The rotor 54 is enclosed within a suitable housing 58 and receives therethrough an entry nozzle 60 which serves to introduce individual fibers into the spinning chamber formed by the housing 58. The individual fibers are introduced to the surface of the rotor 54 in a tangential direction and because of the spinning thereof, are condensed by a process of layering, i.e., the placing of individual fibers one on top of another. The yarn is formed from the individual fibers in the usual manner incident to the rotation of the rotor 54, and exits the chamber formed by the housing 58 through an axial orifice 62.

As indicated, the orifices 50 opening into the housing 46 of the opening means are vacuum orifices. The vacuum imposed on individual fibers through these orifices is developed through a vacuum tube 64 which exits from the chamber formed by the housing 58 of the rotor. Because the rotor, entry nozzle, vacuum tube, and housing function as a unit in forming individual fibers into a yarn, these elements of the invention can be referred to collectively as a break spinning means.

It should be emphasized at this point that each of the conduits 52 which leads from the single opening roller 40 connects with an individual break spinning means. Thus, there may be numerous of these break spinning means associated with a single opening roller. It should also be noted that the particular manner in which the individual fibers are deposited on the rotor, i.e., the layering of the fibers, affords a smooth condensation of the fibers into a mass of sufficient density to afford the yarn density and thickness desired. The fibers are not bunched or tangled, and thus the density and thickness of the yarn is not irregular.

In fluid communication with the vacuum tube 64 leading out of the chamber formed by the housing 58, is a vacuum manifold 66. Though the vacuum manifold is illustrated in the FIGURE as in communication only with a single break spinning means, it should be understood that the manifold can be employed with a plurality of such spinning means, and indeed may service all of the spinning means associated with the single opening roller 40. The vacuum introduced to the system through the vacuum manifold 66 can be developed by any suitable instrumentality such as the vacuum fan 68 as illustrated. In any case, the vacuum is of course only partial and amounts to that defined by a thirty-inch column of water. The magnitude of this vacuum can be varied by varying the output of the vacuum pump so as to vary the velocity of the air passing through the conduits 52. By varying the velocity of air passing through the conduits, differing quantities of fiber can be advanced to the break spinning means and the density and thickness of the yarn produced by each spinning means can be varied.

Each break spinning means is provided with a suitable bypassing means such as the bypassing tube 70 leading from the conduit adjacent the entry nozzle around the housing 58 to the vacuum tube 64 discharging from the housing 58. The bypassing tube 70 is employed to divert the stream of individual fibers otherwise entering the spinner around the housing 58 in the event that an end comes down to the spinning means. Should this occur, the fibers will be diverted around the housing of the spinning means, and yet the other spinning means associated with the single opening roll 40 can continue to operate. Additionally, fibers which would otherwise be conducted into the interior of the spinner are diverted around the chamber thereof so that the spinning means having the broken length of fibers can be rethreaded quickly and placed back in operation without cleaning. Thus, operations can continue essentially uninterrupted but for the particular break spinner having the broken length of fibers.

The individual fibers passing to a spinning means are diverted through the bypassing tube 70 by the action of valves 72 and 73 located at either end of the bypassing tube. In the course of normal operation, the valves 72 assume the posture shown in phantom in the drawing. The bypassing tube is thus closed to fibers entering the spinner. However, should the continuity of the length of fibers to the spinner be interrupted, the valves 72 and 73 operate to close the entry nozzle 60 and open the bypassing tube 70 so that the individual fibers otherwise flowing to the spinner are diverted around the housing thereof. These valves are operated in response to a suitable sensing means, such as a micro-switch 74, activated by yarn pressure during the spinning for the purpose of sensing an interruption in the continuity of the length of fibers passing thereto.

SUMMARY OF THE MAJOR ADVANTAGES OF THE INVENTION

It will be appreciated that in providing the novel apparatus according to this invention for transporting and break spinning fibers into a yarn, certain significant advantages are obtained.

A particular advantage of the invention resides in the fact that the fibers being spun can be completely and efficiently transported in an automated manner through the various stages of the spinning operation without complex mechanism.

Another advantage of the invention is afforded by conveying and break spinning fibers wherein the individual opening rollers, feed rollers and pedals heretofore required on an individual basis for each break spinner or rotor are replaced by a single opening roller for separating the fiber mass into individual fibers to supply fibers to a plurality of break spinners.

Still another advantage of the invention results from the relatively careful control that can be exerted over the flow of the fiber mass to the opening roller whereby the density and thickness of the resulting yarn can be maintained within exceptable tolerances.

Yet still another advantage of the invention is that fibers can be removed from the opening roller on an essentially individual basis or in suitably small groups so that the yarn resulting from the spinning of the fibers is of a relatively uniform density and thickness.

A further advantage of the invention accrues from the fact that the individual fibers can be moved from the opening roller to the break spinner in such a way that the fibers remain straight and essentially parallel to one another and therefore provide a yarn of relatively uniform density and thickness.

Still a further advantage of the invention is afforded by the movement of the fibers from the opening roller to the break spinner quickly, efficiently, and accurately varied so as to provide economically yarns of varying density and thickness.

Yet still a further advantage of the invention results from the fact that the fibers are smoothly condensed upon entering the break spinner and thus do not become tangled or otherwise disarrayed in a manner rendering the resulting yarn of uneven density or thickness.

Still another advantage of the invention is that the fibers are thoroughly and efficiently removed from the opening roller as additional fibers are introduced thereto so that the opening roller does not become matted or the fibers wrapped therearound.

Yet still another advantage of the invention stems from the capability that spinning operations can be continued in large part despite a break in the yarn and fibers otherwise conducted into a break spinner can be diverted therearound while a broken yarn of the spinner is rethreaded.

While the invention has been illustrated and described in one embodiment, it is recognized that variations can be made therein without departing from the invention set forth in the claims.

I claim:

1. An apparatus for conveying and break spinning fibers comprising: opening means for separating a fiber bat essentially into individual fibers; feeding means operably associated with said opening means for feeding the fiber bat to said opening means; a plurality of conduits opening adjacent the peripheral surface of said opening means, each extending to a discrete location remote from said opening means; a vacuum manifold opening into said conduits and operable to draw fibers through the resultant suction from said peripheral surface of said opening means into and along the length of said conduits; and a plurality of break spinning means each connected to the respective conduits and remote from said opening means for spinning fibers conducted from said opening means ingo yarns, said opening means is comprised of an elongated, cylindrical opening roller operable to rotate about the longitudinal axis thereof; a housing at least partially surrounding said opening roller; a cylindrical feeding roller disposed tangentially adjacent said opening roller and operable to rotate about the longitudinal axis thereof to feed the fiber bat to said opening means, each of said plurality of conduits opens at one end to said opening roller with an orifice at a point adjacent the periphery of said opening roller, said orifices formed by said plurality of conduits overlap longitudinally thereof and the sum of the dimensions of the diameters of said orifices measured parallel to the longitudinal axis of said opening roller is greater than the length of said opening roller.

2. An apparatus for conveying and break spinning fibers comprising; opening means for separating a fiber bat essentially into individual fibers; feeding means operably associated with said opening means for feeding the fiber bat to said opening means; a plurality of conduits opening adjacent the peripheral surface of said opening means, each extending to a discrete location remote from said opening means; a vacuum manifold opening into said conduits and operable to draw fibers through the resultant suction from said peripheral surface of said opening means into and along the length of said conduits; and a plurality of break spinning means each connected to the respective conduits and remote from said opening means for spinning fibers conducted from said opening means into yarns, said opening means is comprised of an elongated, cylindrical opening roller operable to rotate about the longitudinal axis thereof; a housing at least partially surrounding said opening roller; a cylindrical feeding roller disposed tangentially adjacent said opening roller and operable to rotate about the longitudinal axis thereof to feed the fiber bat to said opening means, by passing means disposed on each of said plurality of spinning means for diverting fiber otherwise entering said spinning means around said spinning means in the event the continuity of the yarn produced by said spinning means is interrupted.

3. The apparatus of claim 2 wherein said bypassing means comprises a vacuum tube extending from said spinning means; and a bypassing tube extending from said conduit around the spinning means connected thereto and into connection with said vacuum tube.

4. The apparatus of claim 3 further comprised of valve means normally closing said bypassing tube and operable to open said bypass tube and isolate said spinning means associated therewith by admitting to said bypassing tube fibers otherwise entering said spinning means.

5. The apparatus of claim 4 further comprising sensing means operably associated with each spinning means for sensing an interruption in the continuity of a yarn and opening said valves in response thereto.

6. The apparatus of claim 3 wherein each of said plurality of conduits opens at one end into said housing at least partially surounding said opening roller with an orifice at a point adjacent the periphery of said opening roller.

7. The apparatus of claim 6 wherein said orifices formed by said plurality of conduits overlap and the sum of the dimensions of the diameters of said orifices measured parallel to the longitudinal axis of said opening roller is greater than the length of said opening roller.

8. An apparatus for conveying and break spinning fibers comprising: opening means for separating a fiber bat essentially into individual fibers; feeding means operably associated with said opening means for feeding the fiber bat to said opening means; a plurality of conduits opening adjacent the peripheral surface of said opening means, each extending to a discrete location remote from said opening means; a vacuum manifold opening into said conduits and operable to draw fibers through the resultant suction from said peripheral surface of said opening means into and along the length of said conduits; and a plurality of break spinning means each connected to the respective conduits and remote from said opening means for spinning fibers conducted from said opening means into yarns; bypassing means disposed on each of said plurality of spinning means for diverting fiber otherwise entering said spinning means around said spinning means in the event the continuity of the yarn produced by said spinning means is interrupted.

* * * * *